US006381886B1

(12) United States Patent
Chou

(10) Patent No.: US 6,381,886 B1
(45) Date of Patent: May 7, 2002

(54) LICENSE PLATE MOUNTED DISPLAY

(76) Inventor: Fo Chou, 97 Jacklin Ct., Milpitas, CA (US) 95035

( * ) Notice: Subject to any disclaimer, the term of this patent is extended or adjusted under 35 U.S.C. 154(b) by 0 days.

(21) Appl. No.: 09/982,417

(22) Filed: Oct. 18, 2001

(51) Int. Cl.[7] ..... G09F 7/00

(52) U.S. Cl. ..... 40/209; 40/210; 40/658; 24/341; 248/316.7

(58) Field of Search ..... 40/200, 210, 209, 40/591; 24/616, 341; 248/316.7, 229.16, 229.26

(56) References Cited

U.S. PATENT DOCUMENTS

| | | | | |
|---|---|---|---|---|
| 1,494,658 A | | 5/1924 | Willwerscheid | |
| 1,863,902 A | | 6/1932 | Hanson | |
| 2,054,060 A | | 9/1936 | Morris | |
| 2,636,299 A | | 4/1953 | McDermott | |
| 3,408,760 A | | 11/1968 | Barr | |
| 3,908,296 A | | 9/1975 | Harrison | |
| 4,332,362 A | * | 6/1982 | Leopold | 24/341 |
| 4,444,321 A | * | 4/1984 | Carlstom | 24/341 |
| 4,445,291 A | | 5/1984 | Easley | |
| 5,027,537 A | | 7/1991 | Freeman et al. | |
| 5,517,731 A | * | 5/1996 | Spykerman | 24/341 |
| 5,815,976 A | | 10/1998 | Jernigan et al. | |
| 5,878,516 A | | 3/1999 | Amirian | |
| 6,025,784 A | | 2/2000 | Mish | |

* cited by examiner

*Primary Examiner*—Cassandra H. Davis
(74) *Attorney, Agent, or Firm*—Jack Lo

(57) ABSTRACT

The present display is comprised of a first mounting bracket with holes spaced for attaching to a license plate on a vehicle. An arm is attached to the first mounting bracket. A first snap buckle is attached to an outer end of the arm. A display panel has a lower edge attached to a second mounting bracket. A second snap buckle is attached to the second mounting bracket. The display panel is attached to the vehicle by connecting the first and second snap buckles together. The display panel is easily detached or replaced by disconnecting the snap buckles. In a second embodiment, a flag is attached to a third snap buckle for being detachably connected to the first snap buckle.

5 Claims, 4 Drawing Sheets

LICENSE PLATE MOUNTED DISPLAY

BACKGROUND OF THE INVENTION

1. Field of the Invention

This invention relates generally to signs and accessories for mounting on vehicle license plates.

2. Prior Art

Bumpers stickers have been popular for displaying indicia such as messages and advertising on automobiles. However, they are difficult to remove cleanly. Changing them is so inconvenient that they are often left on the vehicle for years until they have long become stale and faded. To improve interchangeability, various removable signs have been devised in the past. A device disclosed in U.S. Pat. No. 1,494,658 to Willwerscheid is comprised of a display panel which is attached to a license plate by a pair of clips. The display panel is coplanar with the license plate, so that it cannot be attached to any license plate which is recessed in a bumper or rear body panel. Another device disclosed in U.S. Pat. No. 5,878,516 to Amirian is comprised of a display panel attached to a L-shaped mounting rail, which is connected to a license plate by a pair of Z-shaped brackets. However, the bottom of the display panel is obscured by the mounting rail. Further, the mounting rail is not easily detachable from the brackets for removing the display panel or changing display panels. Further, none of the prior art display devices is usable for attaching other accessories, such as flags, for personalizing the vehicles.

OBJECTIVES OF THE INVENTION

Accordingly, the objectives of the present license plate mounted display are:

- to display indicia externally on a vehicle for public viewing;
- to provide a display panel which is easily attachable to the vehicle;
- to provide a display panel which is easily detachable and changeable;
- to not obscure the indicia on the display panel; and
- to provide a flag which is interchangeable with the display panel for personalizing the vehicle.

Further objectives of the present invention will become apparent from a consideration of the drawings and ensuing description.

BRIEF SUMMARY OF THE INVENTION

The present display is comprised of a first mounting bracket with holes spaced for attaching to a license plate on a vehicle. An arm is attached to the first mounting bracket. A first snap buckle is attached to an outer end of the arm. A display panel has a lower edge attached to a second mounting bracket. A second snap buckle is attached to the second mounting bracket. The display panel is attached to the vehicle by connecting the first and second snap buckles together. The display panel is easily detached or replaced by disconnecting the snap buckles. In a second embodiment, a flag is attached to a third snap buckle for being detachably connected to the first snap buckle.

DRAWING REFERENCE NUMERALS

10. First Mounting Bracket
11. Clips
12. License Plate
13. Holes
14. Bolt
15. Arm
16. Reinforcing Bar
17. First Snap Buckle
18. Display Panel
19. Tab
20. Second Mounting Bracket
21. Bolts
22. Second Snap Buckle
23. Indicia
24. Flag Pole
25. Flag
26. Third Snap Buckle

DETAILED DESCRIPTION OF THE INVENTION

FIGS. 1–2

Figure 1:
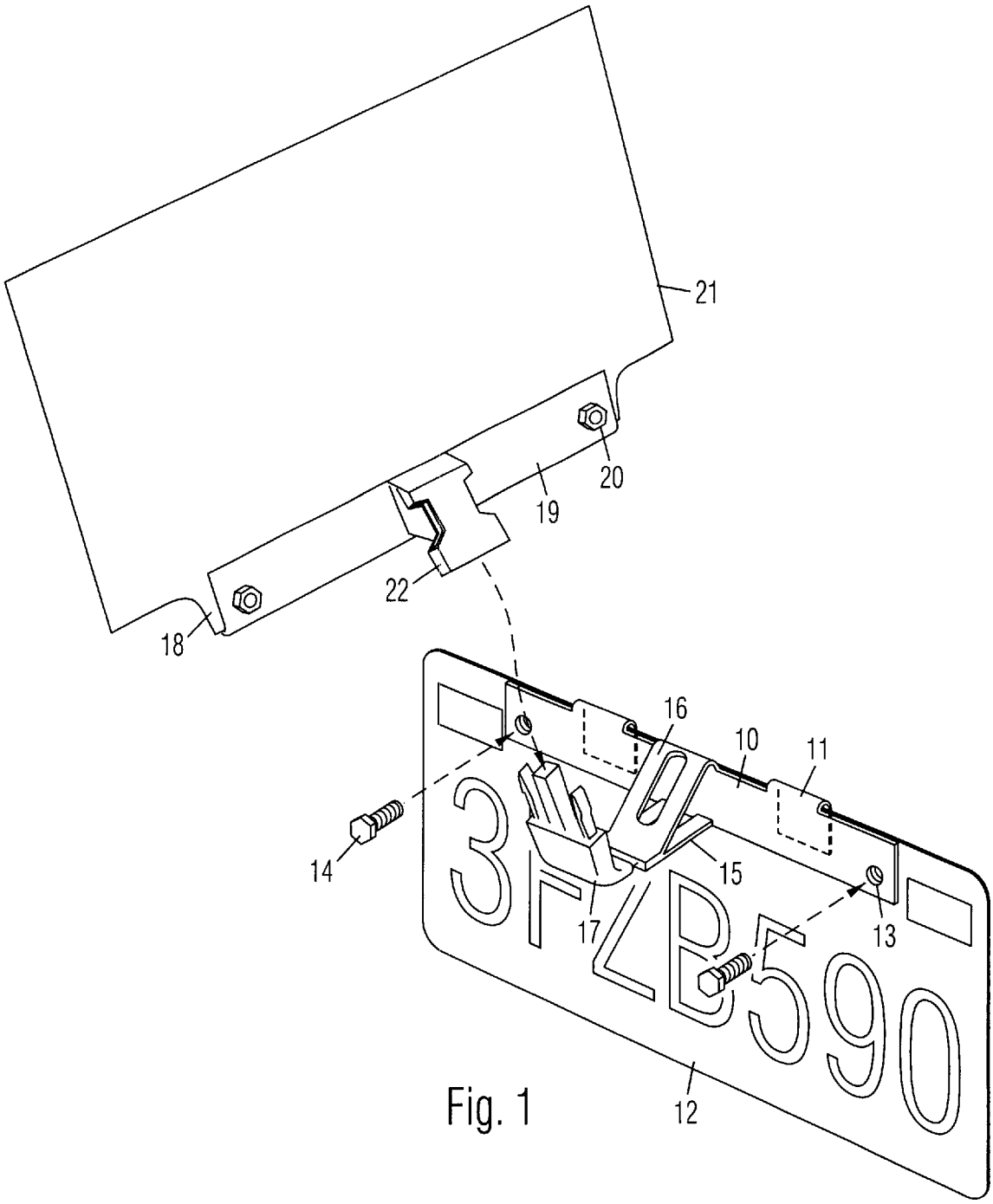
FIG. 1 is an exploded view of the present license plate mounted display.

A first embodiment of the present license plate mounted display is shown in an exploded view in FIG. 1. It is comprised of an elongated first mounting bracket 10 with clips 11 extending downwardly from a top edge thereof for clipping to the top edge of a conventional license plate 12 on a vehicle. A pair of holes 13 at opposite ends of first mounting bracket 10 are spaced for aligning with the holes on license plate 12 and being secured thereto by screws or bolts 14. An arm 15 is attached to first mounting bracket 10 and angled away therefrom, preferably at about 90 degrees. A reinforcing bar 16 is connected between an outer end of arm 15 and first mounting bracket 10 to form a triangular truss for rigidity. A lower end of a first snap buckle 17 is attached to an outer end of arm 15, and is preferably angled away slightly from first mounting bracket 10.

A tab 18 is attached to a second mounting bracket 19 by screws or bolts 20 extending through opposite ends of second mounting bracket 19, which preferably has a U-shaped cross section for securely holding tab 18 therein. A display panel 21 is attached to the top of tab 18. A second snap buckle 22 is attached to the inner side of second mounting bracket 19. The lower end of second snap buckle 22 is preferably angled away slightly from second mounting bracket 19, and is generally level with the lower edge of second mounting bracket 19. The rear of display panel 21 is shown for showing second snap buckle 22. The angles of first and second snap buckles 17 and 22 make connecting them easier.

Figure 2:
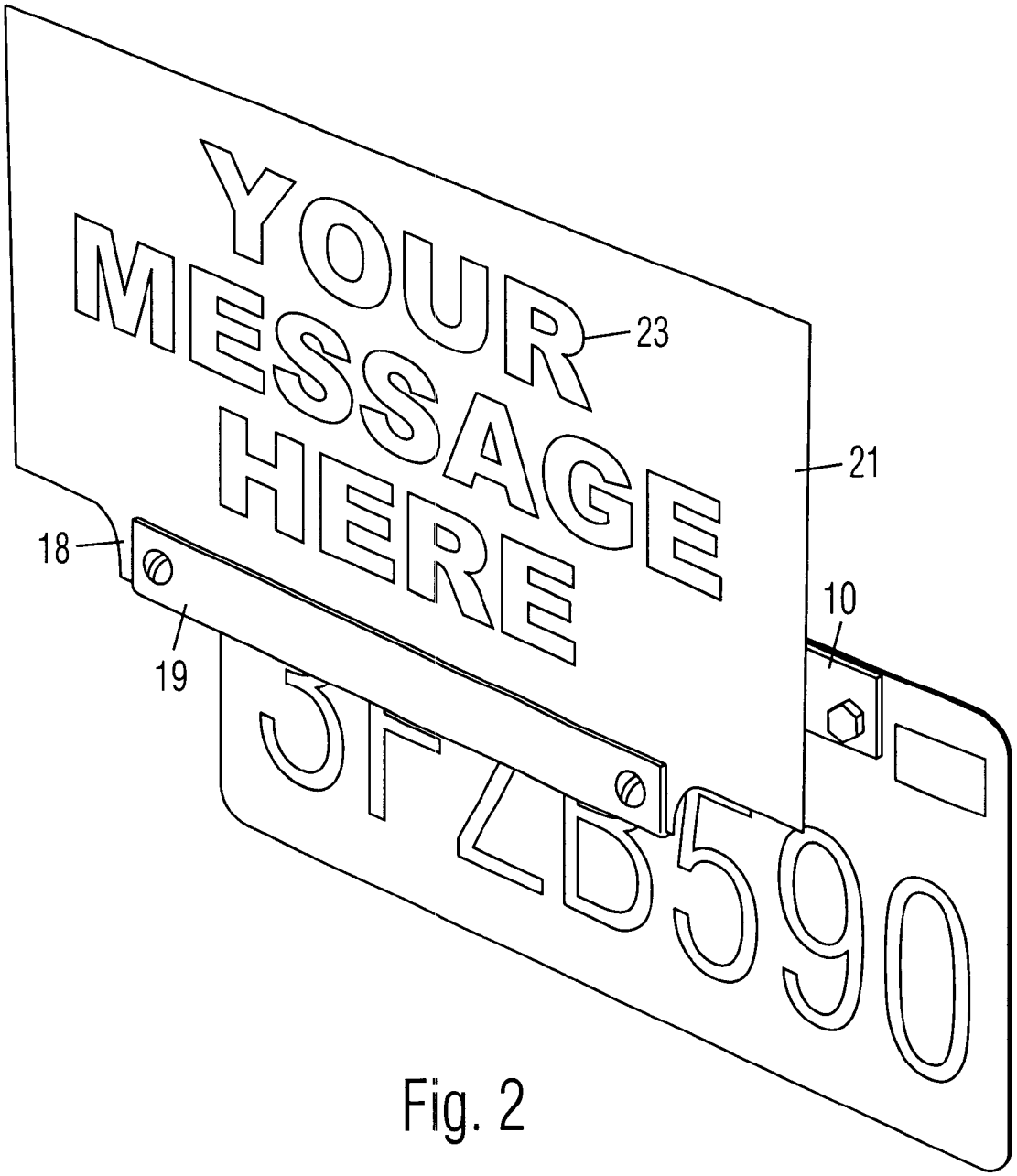
FIG. 2 is a perspective view thereof when assembled.

The present display is shown assembled in FIG. 2. Display panel 21 is easily attached to first mounting bracket 10 by connecting the second snap buckle to the first snap buckle. Indicia 23, such as a message, a company logo, a cartoon, etc., is arranged on the outer side of display panel 21 for public viewing. Display panel 21 is not obscured by second mounting bracket 19 because it is positioned above second mounting bracket 19 by tab 18. Display panel 21 is easily detached by disconnecting the snap buckles, so that display panel 21 can be removed when not needed, or it can replaced with another display panel with different indicia.

FIGS. 3–4

Figure 3:
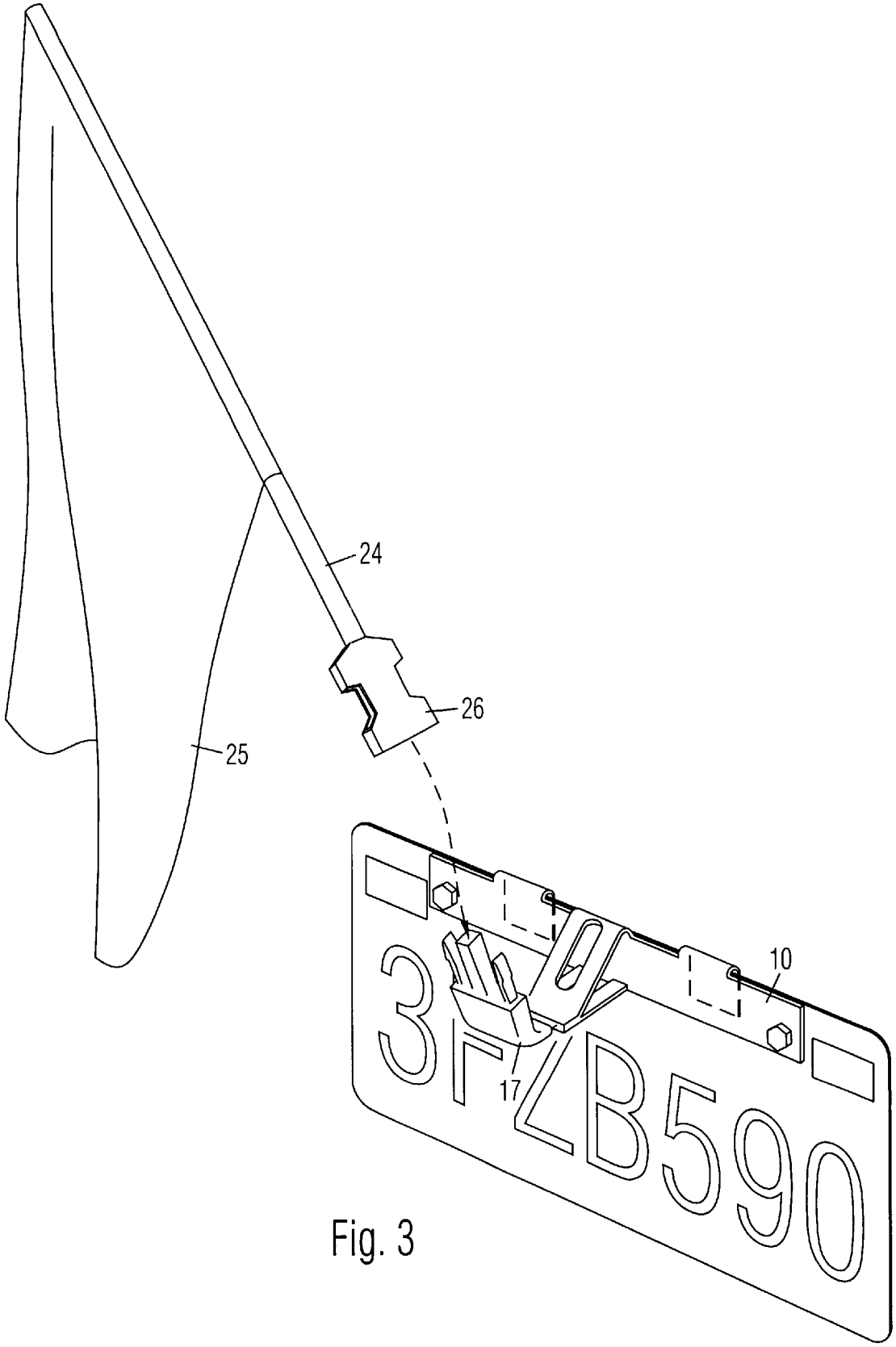
FIG. 3 is an exploded view of a second embodiment thereof.
Figure 4:
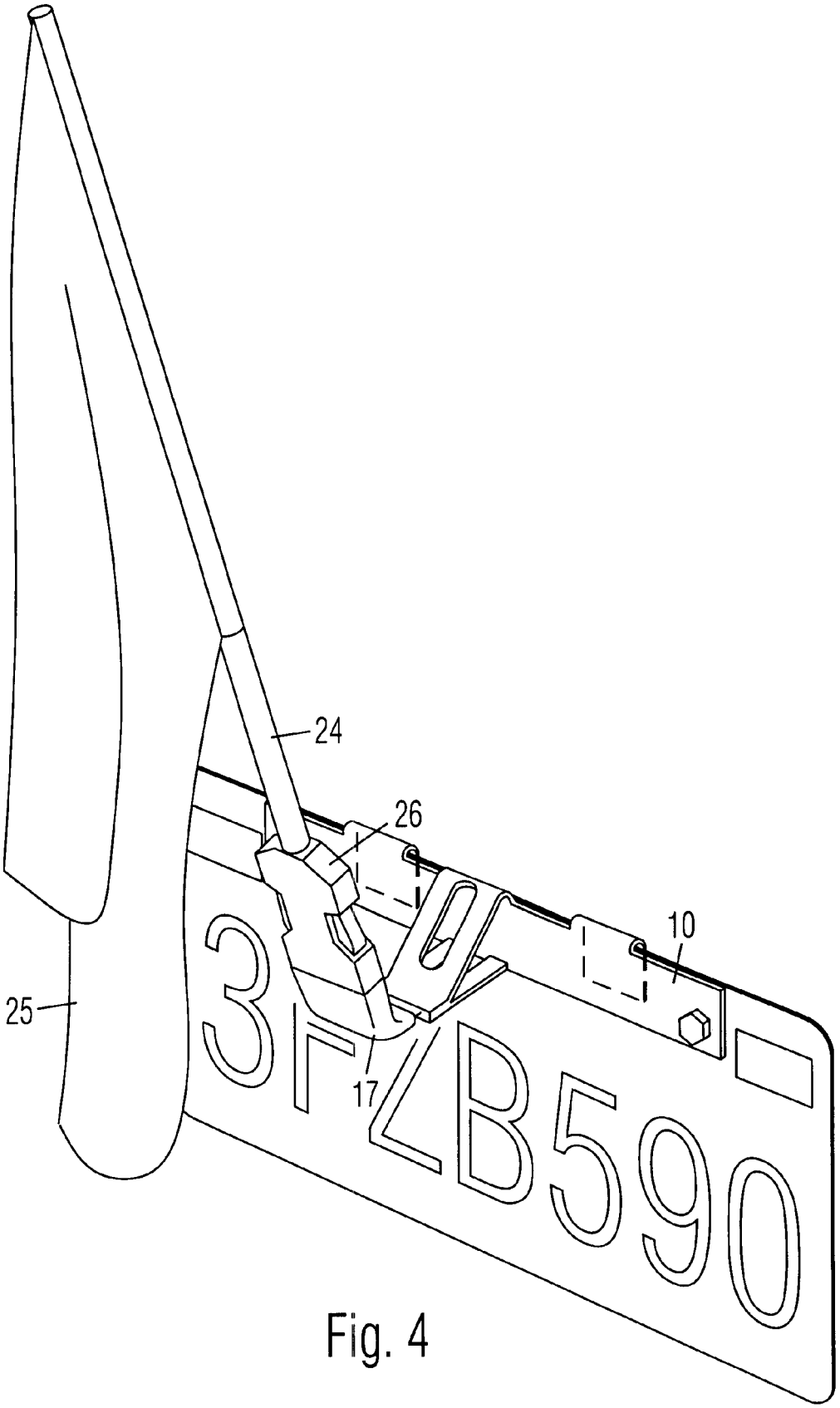
FIG. 4 is a perspective view of the second embodiment in FIG. 3 when assembled.

A second embodiment of the license plate mounted display is shown in an exploded view in FIG. 3. A flag pole 24 with a flag 25 is attached to a third snap buckle 26 for being detachably connected to first snap buckle 17. Flag 25 and flag pole 24 are shown assembled with first mounting bracket 10 in FIG. 4 for personalizing the vehicle, and for making it easier to find in a crowded parking lot.

SUMMARY AND SCOPE

Accordingly, the present license plate mounted display is arranged to display indicia on a vehicle. It provides a display panel which is easily attached to the vehicle. The display panel is easily detachable and changeable. It does not obscure the indicia on the display panel. It also provides a flag which is interchangeable with the display panel for personalizing the vehicle.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A license plate mounted display, comprising:

an elongated first mounting bracket;

a pair of holes near opposite ends of said first mounting, bracket, wherein said holes are spaced for aligning with corresponding holes on a license plate and being secured by screws;

an arm attached to an outer side of said first mounting bracket;

a first snap buckle attached to an outer end of said arm;

a second mounting bracket;

a display panel attached to said second mounting bracket; and a second snap buckle attached to said second mounting bracket and detachably connected to said first snap buckle to enable said second mounting bracket and said display panel to be easily detached and replaced.

2. A license plate mounted display, comprising:

an elongated first mounting bracket;

a pair of holes near opposite ends of said first mounting bracket, wherein said holes are spaced for aligning with corresponding holes on a license plate and being secured by screws;

an arm attached to an outer side of said first mounting bracket;

a first snap buckle attached to an outer end of said arm;

a flag pole with a flag; and a second snap buckle attached to a lower end of said flag pole and detachably connected to said first snap buckle to enable said flag pole and said flag to be easily detached and replaced.

3. A license plate mounted display, comprising:

an elongated first mounting bracket;

a clip extending downwardly from a top edge of said first mounting bracket on an inner side thereof for clipping to a top edge of a conventional license plate on a vehicle;

a pair of holes near opposite ends of said first mounting bracket, wherein said holes are spaced for aligning with corresponding holes on said license plate and being secured by screws;

an arm attached to an outer side of said first mounting bracket;

a reinforcing bar connected between said arm and said first mounting bracket to form a triangular truss for rigidity;

a first snap buckle with a lower end attached to an outer end of said arm, wherein a top end of said first snap buckle is angled away from said first mounting bracket;

a U-shaped second mounting bracket;

a display panel with surface indicia;

a tab extending along a bottom edge of said display panel and inserted into said second mounting bracket, wherein said display panel is positioned above said second mounting bracket by said tab so that said indicia is not obscured by said second mounting bracket; and a second snap buckle attached to said second mounting bracket, wherein a lower end of said second snap buckle is angled away from said second mounting bracket, said second snap buckle is detachably connected to said top end of said first snap buckle to enable said second mounting bracket and said display panel to be easily detached and replaced;

wherein the angles of said first snap buckle and said second snap buckle are arranged to facilitate connection.

4. The license plate mounted display of claim 3, wherein said display panel has a predetermined width, and said tab is substantially less than said width.

5. A license plate mounted display, comprising:

an elongated first mounting bracket;

a clip extending downwardly from a top edge of said first mounting bracket on an inner side thereof for clipping to a top edge of a conventional license plate on a vehicle;

a pair of holes near opposite ends of said first mounting bracket, wherein said holes are spaced for aligning with corresponding holes on said license plate and being secured by screws;

an arm attached to an outer side of said first mounting bracket;

a reinforcing bar connected between said arm and said first mounting bracket to form a triangular truss for rigidity;

a first snap buckle with a lower end attached to an outer end of said arm, wherein a top end of said first snap buckle is angled away from said first mounting bracket;

a flag pole with a flag; and a second snap buckle attached to a lower end of said flag pole and detachably connected to said top end of said first snap buckle to enable said flag pole and said flag to be easily detached and replaced;

wherein the angle of said first snap buckle is arranged to angle said flag pole away from said vehicle.

* * * * *